United States Patent [19]

Kretchman et al.

[11] Patent Number: 4,989,426

[45] Date of Patent: Feb. 5, 1991

[54] WASHER/DRYER FRAME CONSTRUCTION

[75] Inventors: Gerald L. Kretchman, St. Joseph Township, Berrien County; James R. Mulder, Berrien Township, Berrien County; Carl E. Eichman; James I. Czech, both of Lincoln Township, Berrien County, all of Mich.

[73] Assignee: Whirlpool Corporation, Benton Harbor, Mich.

[21] Appl. No.: 519,312

[22] Filed: May 8, 1990

Related U.S. Application Data

[63] Continuation of Ser. No. 7/350,725, May 12, 1989, abandoned.

[51] Int. Cl.[5] ..... D06F 29/02

[52] U.S. Cl. ..... 68/3 R; 68/20; 248/676; 312/253; 312/265.3; 312/278

[58] Field of Search ..... 68/3 R, 19.1, 19.2, 68/20; 134/115 R; 312/228, 253, 265.1, 265.2, 265.3, 265.4, 278; 248/163.1, 676

[56] References Cited

U.S. PATENT DOCUMENTS

| | | | |
|---|---|---|---|
| 1,585,102 | 5/1926 | Langdon | 312/256 X |
| 1,763,306 | 6/1930 | Hendrickson | 312/278 X |
| 2,793,518 | 5/1957 | Geldhof | 68/19.2 |
| 2,833,137 | 5/1958 | Geldhof | 68/19.2 |
| 2,866,273 | 12/1958 | Geldhof | 68/20 X |
| 2,899,253 | 8/1959 | Jacobs | 312/265.3 |
| 3,139,744 | 7/1964 | Van Alstyne et al. | 68/20 |
| 3,545,235 | 12/1970 | Menk | 68/20 X |
| 4,306,325 | 12/1981 | Pyle et al. | 15/53 A |
| 4,454,732 | 6/1984 | Burkland et al. | 68/3 R |
| 4,462,225 | 7/1984 | Noe | 68/3 R |
| 4,507,942 | 4/1985 | Hirose et al. | 68/20 |
| 4,680,948 | 7/1987 | Rummel et al. | 68/3 R |
| 4,713,949 | 12/1987 | Wilcox | 68/3 R X |
| 4,821,535 | 4/1989 | Wassilak | 68/3 R |

FOREIGN PATENT DOCUMENTS

| | | | |
|---|---|---|---|
| 158897 | 8/1985 | Japan | 68/20 |

*Primary Examiner*—Philip R. Coe

*Attorney, Agent, or Firm*—Hill, Van Santen, Steadman & Simpson

[57] ABSTRACT

A support structure for a vertically arranged combination household appliance, more particularly a front loading dryer assembly arranged above a top loading washer assembly, includes vertical main support members, horizontal members and other members. The structure adequately supports both appliance assemblies of the combination appliance during transportation and usage, provides improved operating performance during off balance washer spin conditions or dryer tumbling, and maintains unitary appliance characteristics by being an integral part of the combination appliance design and by being located entirely interior to the appliance cabinetry.

16 Claims, 2 Drawing Sheets

FIG. 3
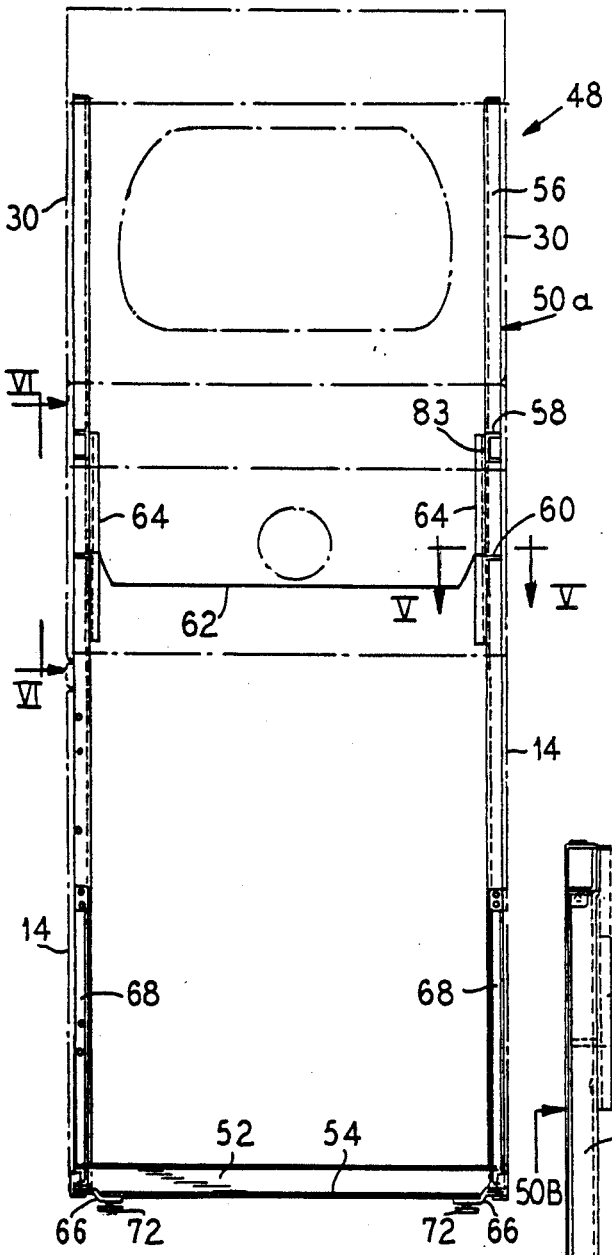
FIG. 5
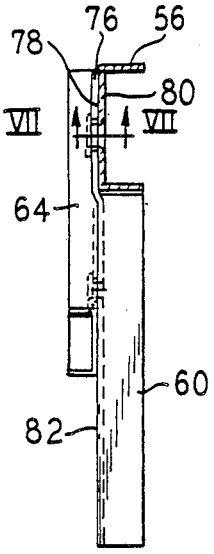
FIG. 4
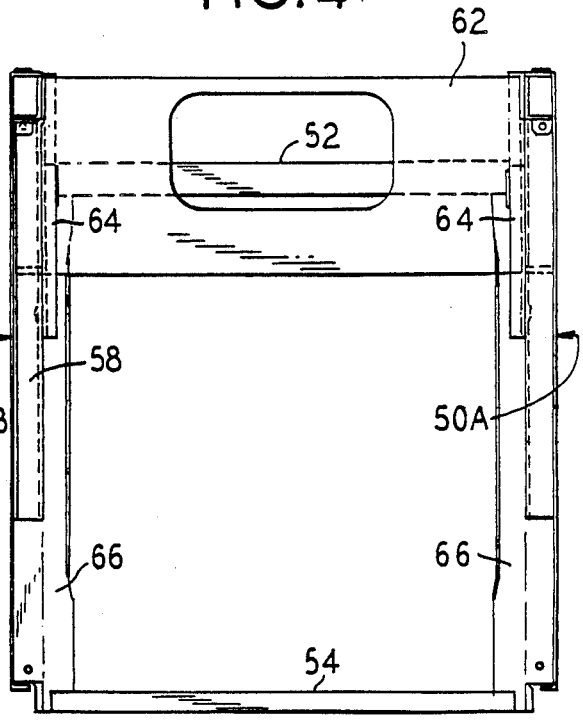
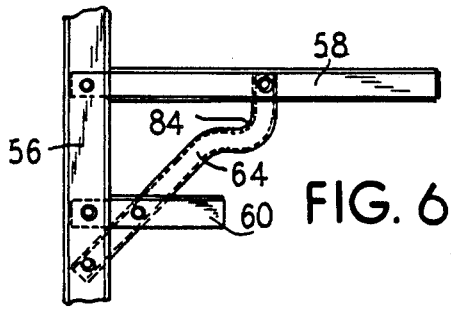
FIG. 6

WASHER/DRYER FRAME CONSTRUCTION

This is a continuation of application Ser. No. 350,725 filed May 12, 1989, and now abandoned.

BACKGROUND OF THE INVENTION

This invention relates generally to domestic appliances and more particularly to a support structure for a combined washer/dryer appliance with a front loading dryer positioned above a top loading washer.

The vertical arrangement of washers and dryers is known in the art wherein substantially complete and independent washer and dryer appliances are stacked one above the other with various support elements carrying the load of the upper appliance. Such an arrangement is employed to conserve floor space and increase the ease of use of the appliances by positioning the openings of the two appliances closely adjacent to one another to reduce movement required by the operator while moving articles from one appliance to the other. Such a stacked arrangement is disclosed in U.S. Pat. No. 2,793,518.

U.S. Pat. Nos. 4,507,942, and 4,680,948 disclose external support brackets or carriers for stacking a front loading dryer above a top loading washer. These external support systems apparently rely on the lower appliance cabinet for structural support of the upper cabinet. The lower appliance cabinet must support operating and handling loads and can permanently deform when the machine is being moved about.

U.S. Pat. No. 4,454,732 discloses a structural assembly for stacking two appliances. This assembly transfers the upper appliance weight to supporting feet. The lower appliance is supported by separate and independent supporting feet.

SUMMARY OF THE INVENTION

The present invention relates to domestic appliances and more particularly to a vertically arranged washer/dryer combination appliance wherein a single appliance, having multiple components, such as a washer component and a dryer component, is constructed as a unitary appliance onto a single support frame.

It is an object of the invention to provide a support structure for a unitary appliance which adequately supports the combination appliance during transportation and during usage; which improves operating performance as compared to stacked type appliance structure concepts; and which accomplishes these tasks without compromising the unitary appliance characteristics of the appliance cabinetry. In a structural support system as initially described, these objectives are accomplished in that:

1. A structural support system consisting of vertical, horizontal and diagonal framing members provides overall vertical support rigidity. Vertically arranged combination appliances are more susceptible to handling damage because of their bulk and weight. In a unit without the internal structure utilized by the present invention, the cabinetry of the appliance must support operating and handling loads, and can be permanently deformed when the machine is being moved about. The present invention alleviates this problem.

2. The structural support system, with dryer assembly and washer assembly supported on a common base, causes the total mass of the combination appliance to be coupled more rigidly to the floor through the supporting feet of the common base. The support system provides superior operating performance during off balance washer spin conditions or dryer tumbling. The support system provides a framework which minimizes deflection of the combination appliance during off balance load conditions, resulting in a combination appliance which has reduced exterior vibration during operation.

3. The structural support framework, as an integral part of the combination appliance assembly, residing entirely inside the cabinetry of the combination appliance, maintains unitary appliance characteristics more so than other stacked type combination appliances.

BRIEF DESCRIPTION OF THE DRAWINGS

FIG. 3 is a front elevational view of the washer and dryer combination appliance support structure embodying the principles of the present invention.

FIG. 4 is a top plan view of the washer and dryer combination appliance support structure embodying the principles of the present invention.

FIG. 5 is a fragmentary sectional view taken generally along line V—V of FIG. 3.

FIG. 6 is a fragmentary elevational view of the left side of the support structure taken generally along line VI—VI of FIG. 3.

DETAILED DESCRIPTION OF THE PREFERRED EMBODIMENTS

Figure 1:
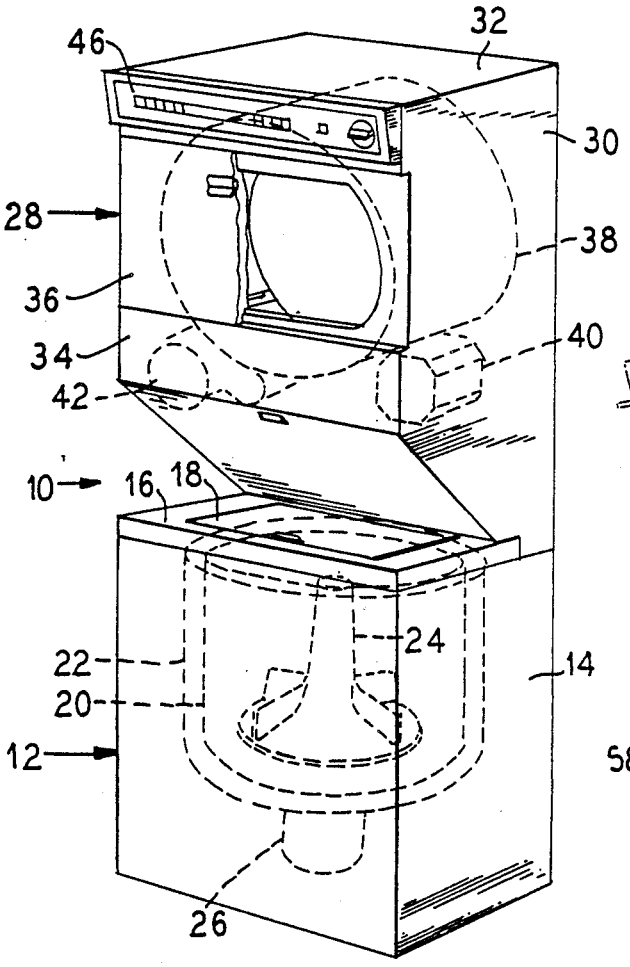
FIG. 1 is a perspective view of a dryer assembly positioned above a washer assembly showing the external appearance of the appliance cabinetry, with appliance components in phantom.

In FIG. 1 there is illustrated a combination washer/dryer appliance at 10 comprising a clothes washing machine assembly or washer assembly generally at 12 which is enclosed by side panels 14 and a top panel 16. In the top panel 16 there is a hinged access door 18 which provides access to the interior of the washer assembly wherein a wash basket 20 is concentrically mounted within a wash tub 22. A vertical axis agitator 24 is carried within the wash basket 20 and is selectively driven by an electric motor gear case 26. The clothes washing machine assembly is supported on base frame members 66 shown in FIGS. 2, 3 and 4.

A dryer assembly 28 is mounted in a vertical relationship above the washer assembly 12. The dryer assembly 28 is enclosed by side panels 30 and a top panel 32. A front panel 34 has a hinged door 36 which provides access to the interior of a rotatable drum 38 in which the clothes are to be placed for drying. The drum 38 is rotated by means of an electric motor 40, and an air handling system 42 is provided to supply tempered air to the interior of the drum. Moist air is exhausted from the appliance through a selected opening in the cabinet such as openings 44A (FIG. 2) or 44B (FIG. 3) depending on the placement of the combination washer/dryer appliance. Controls 46 are also provided on the front panel 34 of the dryer assembly through which the user can operate the washer/dryer combination appliance.

Figure 2:
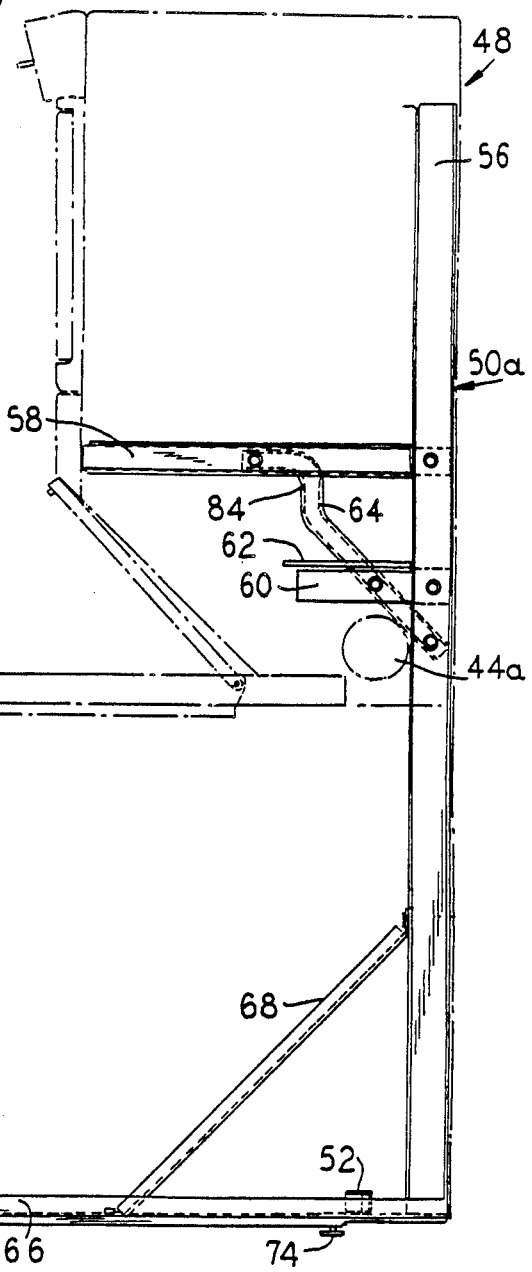
FIG. 2 is a right side elevation view of the washer and dryer combination appliance support structure embodying the principles of the present invention with the appliance cabinetry in phantom.

A unitary support structure 48 embodying principles of the present invention is shown in greater detail in FIGS. 2–4 as having a right-hand frame 50A, a left-hand frame 50B and bottom connecting cross members 52 and 54. In FIG. 2, it is seen that the right-hand frame 50A is composed of a plurality of components. A vertical main support member 56, a horizontal dryer support member 58, and a lower horizontal dryer base support member 60 are connected together by an angled brace member 64. Horizontal dryer support 58 and lower horizontal dryer base support 60 carry a portion of the supported weight of the dryer assembly 28. Lower horizontal dryer base support member 60 directly supports a dryer assembly base plate 62 upon which various components of the dryer assembly are directly mounted such as the motor 40, an electrical terminal block, and exhaust duct work. Support member 58 carries, among other things, a front panel assembly, including a front bulk head for the dryer. Main vertical support member 56 and brace member 64 support members 58 and 60, along with the portion of the supported weight of the dryer assembly 28 which members 58 and 60 support. Main vertical support member 56 also directly carries an additional portion of the supported weight of the dryer assembly 28 such as rear panel assembly including a rear bulk head of the dryer assembly. The vertical main support member 56 is connected to a base frame member 66, and both are connected by diagonal brace member 68. The vertical main support member 56 acts as a rear support of the washer side panels 14. The vertical main support member 56 and diagonal brace member 68 transfer support loads from the dryer assembly 28 to the base frame members 66 which in turn transfer such support loads to a supporting surface, such as a floor, via adjustable leveling feet 72 at a front of the support structure 48, and via self-leveling supporting feet 74 at a rear of the support structure 48.

FIG. 3 shows both the right-hand frame 50A and the left-hand frame 50B of the support structure 48. The left-hand frame 50B of the support structure 48 is similar to the right-hand frame 50A. Similar to the right-hand frame 50A of the support structure 48, vertical main support member 56 of the left-hand frame 50B of the support structure, connected to the diagonal brace member 68 and also connected to a base frame member similar to base frame member 66, supports the dryer assembly 28 and acts as a rear support of the washer side panels 14. The diagonal brace member 68 connects the bottom base frame member 66 and vertical main support member 56. The main vertical support member 56 and diagonal brace member 68 transfer support loads to the base frame member 66 which in turn transfers such support loads to the supporting surface, such as the floor, via adjustable leveling feet 72 and self-leveling supporting feet 74 (shown in FIG. 2) as described above.

FIG. 3 also shows that both the left-hand frame 50B of the support structure 48 and the right-hand frame 50A of the support structure 48 are entirely interior of washer assembly side panels 14 and dryer assembly side panels 30, maintaining the visual characteristics of a unitary appliance.

FIG. 3 shows the left-hand frame 50B and base frame member 66 connected to the right-hand frame 50A and base frame member 66 by cross member 52. Cross member 52 adds stability to the support structure near the rear of the support structure and cross frame member 54 adds further stability to the support structure near the front of the support structure.

FIG. 4 shows the relative location of the cross members 52 and 54 with respect to the left-hand frame 50B and the right-hand frame 50A of the support structure 48 and to the base frame members 66.

FIG. 5, which is a section generally along line V—V of FIG. 3, details the connection between the vertical main support member 56, brace member 64 and lower horizontal dryer base support member 60. In the preferred embodiment, vertical main support member 56 is a U-shaped channel member, open to the exterior of the appliance, lower horizontal dryer base support member 60 is an L-shaped member with an integral offset end extension 76 which connects to an inside (left side in FIG. 5) vertical face 78 of a web portion 80 of the right-hand frame 50A vertical main support member 56 such that the inside face 78 of the web portion 80 is co-planar with a lateral inside vertical surface 82 of the lower horizontal dryer base support member 60. Thus, the brace member 64, which preferably is formed of a U-shaped channel member, will lie flush against surfaces 78 and 82 and also flush against a vertical surface 83 of the support member 58 (FIG. 3), being oriented so as to open toward the interior of the appliance. The connection of the left-hand frame 50A of the support structure members 56, 64, and 60 is similar as shown in FIG. 6. The dryer assembly can be secured to the vertical surface 78, 83 of the support members 56 and support members 58 by appropriate fastening means such as threaded fasteners as well known to those skilled in the art.

FIG. 6 shows that the left-hand frame 50B of the support structure 48 comprises the vertical main support member 56, the horizontal dryer support member 58, and the lower horizontal dryer base support member 60 all connected by the brace member 64. Members 56, 58, 60 and 64 act together to support the dryer assembly 28. Similar to the right-hand frame 50A of the support structure the dryer assembly base 62 (shown in FIG. 2) is supported by lower horizontal dryer base support member 60. The brace member 64 is illustrated as having a bend 84 therein, which is provided merely to allow clearance in a particular dryer assembly construction utilized by the assignee of applicant, and is not critical to the invention. The left-hand frame and right-hand frame brace members 64 as illustrated in FIGS. 6 and 2 respectively, appear to be configured differently, however, one is merely inverted relative to the other so that different right-hand frame brace member 64 and left-hand frame brace member 64 are not required, a single configuration being useable for both left-hand and right-hand frames.

Figure 7:
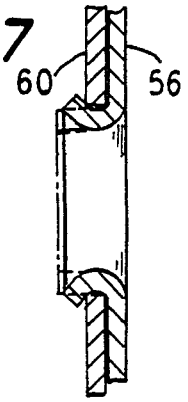
FIG. 7 is a sectional view of a means of attachment of the support structure members taken generally along line VII—VII of FIG. 5.

FIG. 7, which is the section through VII—VII of FIG. 5, details a preferred method of connecting the members: 56 to 58, 58 to 64, 64 to 60, 60 to 56, and 64 to 56. The members are mashed and coined together, providing a tight connection with virtually no play and minimal assembly labor required. No separate fasteners are required, nor is labor intensive welding needed.

As is apparent from the forgoing specification, the invention is susceptible of being embodied with various alterations and modifications which may differ particularly from those that have been described in the preceding specification and description. It should be understood that we wish to embody within the scope of the patent warranted hereon all such modifications as reasonable and properly come within the scope of our contribution to the art.

We claim as our invention:

1. A vertically arranged unitary and fully self-supporting combination appliance comprising:

a lower appliance assembly;

an upper appliance assembly, positioned above said lower appliance assembly;

a cabinet enclosing said upper appliance assembly and said lower appliance assembly;

a base in contact with said lower appliance assembly and in contact with a supporting surface, such that said lower appliance assembly is fully supported through said base; and a support structure to mount said upper appliance assembly above said lower appliance assembly, said support structure being enclosed within said cabinet, and said support structure fully supporting said upper appliance assembly through said base, said support structure comprising means for providing structural integrity to said combination appliance during transportation and operation, and said support structure comprising:

a first means for supporting the weight of the upper appliance assembly comprising at least one vertical main support member; and at least one horizontal support member attached to said vertical main support member, in cantilever fashion and extending along a depth of said upper appliance assembly and attached to said upper appliance assembly such that a substantial overhanging portion of the supported weight of said upper appliance assembly is supported by said horizontal support member, and said horizontal support member transfers the substantial overhanging portion of the supported weight to said vertical main support member; and said base comprises:

a second means for fully supporting the first means comprising at least one base frame member attached to said vertical main support member and extending along a depth of said lower appliance assembly such that the substantial overhanging portion of the supported weight of said upper appliance assembly is transferred from said vertical main support member to said base frame member, and said base frame member transfers force caused by the supported weight to the supporting surface.

2. A vertically arranged combination appliance comprising:

a lower appliance assembly;

an upper appliance assembly, positioned above said lower appliance assembly;

a cabinet enclosing said upper appliance assembly and said lower appliance assembly;

a base in contact with said lower appliance assembly and in contact with a supporting surface, such that said lower appliance assembly is supported through said base, said base comprising at least one base frame member; and a support structure to mount said upper appliance assembly above said lower appliance assembly, said support structure being enclosed within said cabinet, and said support structure supporting said upper appliance assembly through said base, said support structure comprising:

at least one vertical main support member attached to said at least one base frame member;

at least one horizontal support member attached to said vertical main support member, and attached to said upper appliance assembly such that a portion of the supported weight of said upper appliance assembly is transferred to said horizontal support member, and said horizontal support member transfers the portion of the supported weight to said vertical main support member, the portion of the supported weight of said upper appliance assembly is transferred from said vertical main support member to said base frame member, and said base frame member transfers the supported weight to the supporting surface;

an upper assembly base plate;

at least one additional horizontal support member, located beneath said horizontal support member, and attached to said vertical main support member, said additional horizontal support member supporting said upper assembly base plate;

at least one brace member connecting said horizontal support member, and said additional horizontal support member, and said vertical main support member; and at least one diagonal brace member connecting said vertical main support member and said base frame member.

3. A vertically arranged unitary and fully self-supporting combination appliance comprising:

a lower appliance assembly;

an upper appliance assembly, positioned above said lower appliance assembly;

a cabinet enclosing said upper appliance assembly and said lower appliance assembly;

a base in contact with said lower appliance assembly and in contact with a supporting surface, such that said lower appliance assembly is fully supported through said base; and a support structure to mount said upper appliance assembly above said lower appliance assembly, said support structure being enclosed within said cabinet, and said support structure fully supporting said upper appliance assembly through said base, said support structure comprising means for providing structural integrity to said combination appliance during transportation and operation, wherein said support structure comprises two frames, a left-hand frame and a right-hand frame, said frames generally upright and fixed in a horizontally spaced-apart posture, and each frame comprising:

a vertical main support member attached to said upper appliance assembly and supporting a portion of the supported weight of said upper appliance assembly; and a horizontal support member attached to said vertical main support member in cantilever fashion and extending along a depth of said upper appliance assembly, and attached to said upper appliance assembly such that an additional substantial overhanging portion of the supported weight of said upper appliance assembly is transferred to said horizontal support member, and said horizontal support member transfers the additional substantial overhanging portion of the supported weight to said vertical main support member; and said base comprises:

two base frame members, a left-hand base frame member and a right-hand base frame member, each attached to one vertical main support member in contact with said base and at least one of said base frame members extending along a depth of said lower appliance assembly such that the supported weight of said upper appliance assembly is transferred from said vertical main support members to said base frame members, and said base frame members transfer force caused by the supported weight to the supporting surface.

4. A vertically arranged combination appliance comprising:

a lower appliance assembly;

an upper appliance assembly, positioned above said lower appliance assembly;

a cabinet enclosing said upper appliance assembly and said lower appliance assembly;

a base in contact with said lower appliance assembly and in contact with a supporting surface, such that said lower appliance assembly is supported through said base; a support structure to mount said upper appliance assembly above said lower appliance assembly, said support structure being enclosed within said cabinet, and said support structure supporting said upper appliance assembly through said base, wherein said support structure comprises two frames, a left-hand frame and a right-hand frame, said frames generally upright and fixed in a horizontally space-apart posture, and each frame comprising:

a vertical main support member attached to said upper appliance assembly and supporting a portion of the supported weight of said upper appliance assembly;

a horizontal support member attached to said vertical main support member, and attached to said upper appliance assembly such that an additional portion of the supported weight of said upper appliance assembly is transferred to said horizontal support member and said horizontal support member transfers the additional portion of the supported weight to said vertical main support member; and said base comprises two base frame members, a left-hand base frame member and right-hand base frame member, each attached to one vertical main support member such that the supported weight of said upper appliance assembly is transferred from said vertical main support members to said base frame members, and said base frame members transfer the supported weight to the supporting surface; and said support structure further comprises an upper assembly base plate and each of said frames further comprises:

an additional horizontal support member located beneath said horizontal support member and attached to said vertical main support member, said additional horizontal support member supporting said upper assembly base plate;

a brace member connecting said horizontal support member, said additional horizontal support member, and said vertical main support member; and a diagonal brace member connecting each vertical main support member and one base frame member.

5. A vertically arranged combination appliance according to claim 4 wherein said support structure further comprises at least one cross member connecting said left-hand base frame member to said right-hand base frame member.

6. A vertically arranged combination appliance according to claim 4 wherein said support structure further comprises:

a first cross member connecting said left-hand base frame member to said right-hand base frame member, said first cross member located near a rearward end of said base frame members; and a second cross member connecting said left-hand base frame member to said right-hand base frame member, said second cross member located near a forward end of said base frame members.

7. A vertically arranged combination appliance according to claim 4 wherein at least one of:

the attachment of said horizontal support members to said vertical main support members; and the attachment of said additional horizontal support members to said vertical main support members; and the attachment of said brace members to said horizontal support members; and the attachment of said brace members to said additional horizontal support members; and the attachment of said brace members to said vertical main support members;

comprise a mashed and coined attachment.

8. A vertically arranged washer/dryer combination appliance comprising:

a means for washing clothing;

a means for drying clothing, positioned above said means for washing clothing;

a cabinet enclosing said means for washing clothing and said means for drying clothing;

a base in contact with said means for washing clothing and in contact with a supporting surface, such that said means for washing clothing is supported through said base;

a support structure to mount said means for drying clothing above said means for washing clothing, wherein said support structure is enclosed within said cabinet, and said support structure supports said means for drying clothing through said base.

wherein said support structure comprises:

at least one vertical main support member, attached to said means for drying clothing and supporting a portion of the supported weight of said means for drying clothing; and at least one horizontal dryer support member attached to said vertical main support member, and attached to said means for drying clothing such that an additional portion of the supported weight of said means for drying clothing is transferred to said horizontal dryer support member and said horizontal dryer support member transfers the additional portion of the supported weight to said vertical main support member; and said base comprises:

at least one base frame member attached to said vertical main support member such that the supported weight of said means for drying clothing is transferred from said vertical main support member to said base frame member, and said base frame member transfers the supported weight to the supporting surface.

9. A vertically arranged washer/dryer combination appliance according to claim 8 wherein said support structure further comprises:

a dryer base plate;

at least one lower horizontal dryer base support member located beneath said horizontal dryer support member and attached to said vertical main support member, said lower horizontal dryer base support member supporting said dryer base plate;

at least one brace member connecting said horizontal dryer support member, and said lower horizontal dryer base support member, and said vertical main support member; and at least one diagonal brace connecting said vertical main support member and said base frame member.

10. A vertically arranged washer/dryer combination appliance according to claim 8 wherein said support structure comprises two frames, a left-hand frame and a right-hand frame, said frames generally upright and fixed in a horizontally spaced-apart posture, and each frame comprises:

a vertical main support member, attached to said means for drying clothing and supporting a portion of the supported weight of said means for drying clothing; and a horizontal support member attached to said vertical main support member, and attached to said means for drying clothing such that an additional portion of the supported weight of said means for drying clothing is transferred to said horizontal support member, and said horizontal support member transfers the additional portion of the supported weight to said vertical main support member; and said base comprises:

two base frame members, a left-hand base frame member and right-hand base frame member, each attached to one vertical main support member such that the supported weight of said means for drying clothing is transferred from said vertical main support members to said base frame members, and said base frame members transfer the supported weight to the supporting surface.

11. A vertically arranged washer/dryer combination appliance according to claim 10 wherein said support structure further comprises a dryer base plate and each of said frames further comprises:

a lower horizontal dryer base support member, located beneath said horizontal dryer support member, and attached to said vertical main support member, said lower horizontal dryer base support member supporting said dryer base plate;

a brace member connecting said horizontal dryer support member, and said lower horizontal dryer base support member, and attached to said vertical main support member; and a diagonal brace member connecting each vertical main support member and one base frame member.

12. A vertically arranged washer/dryer according to claim 11 wherein said support structure further comprises at least one cross member connecting said left-hand base frame member to said right-hand base frame member.

13. A vertically arranged combination appliance according to claim 11 wherein said support structure further comprises:

a first cross member connecting said left-hand base frame member to said right-hand base frame member, said first cross member located near a rearward end of said base frame members; and a second cross member connecting said left-hand base frame member to said right-hand base frame member, said second cross member located near a forward end of said base frame members.

14. A vertically arranged washer/dryer combination appliance according to claim 11 wherein at least one of:

the attachment of said horizontal dryer support members to said vertical main support members; and the attachment of said lower horizontal dryer base support members to said vertical main support members; and the attachment of said brace members to said horizontal dryer support members; and the attachment of said brace members to said lower horizontal dryer base support members; and the attachment of said brace members to said vertical main support members;

comprise a mashed and coined attachment.

15. A unitary support structure according to claim 8 wherein said base frame member comprises a generally rectangular base frame assembly having a plurality of support surface engaging feet thereon for supporting the entire support structure.

16. A unitary support structure for a combination appliance comprising:

a base portion comprising a generally rectangular base frame assembly having a plurality of support surface engaging feet thereon;

means for supporting a first appliance assembly on said base portion;

a vertical support portion attached to and supported by said base portion;

means for supporting a second appliance assembly on said support portion above said first appliance assembly, wherein both said first appliance assembly and said second appliance assembly are supported by said base portion; and said vertical support portion comprising at least two vertically extending support members, each having at least one horizontally extending support arm secured thereto for supporting said second appliance assembly in a cantilevered manner;

and said means for supporting said first appliance assembly comprises a horizontal surface area on said base frame assembly engagable with said first appliance assembly, and said means for supporting said second appliance assembly comprises vertical surface areas on said vertically extending support members and said horizontally extending support arms engagable with said second appliance assembly to permit engagement of fastening means between at least one of said vertically extending support members and horizontally extending support arms and said second appliance assembly.

and said means for supporting said first appliance assembly comprises a horizontal surface area on said base frame assembly engagable with said first appliance assembly, and said means for supporting said second appliance assembly comprises vertical surface areas on said vertically extending support members and said horizontally extending support arms engagable with said second appliance assembly to permit engagement of fastening means between at least one of said vertically extending support members and horizontally extending support arms and said second appliance assembly.

* * * * *